United States Patent [19]

Holder

[11] Patent Number: 4,494,248

[45] Date of Patent: Jan. 22, 1985

[54] FABU PATIENT GOWN

[76] Inventor: Percy E. A. Holder, 188 Veronica Pl., Brooklyn, N.Y. 11226

[21] Appl. No.: 379,183

[22] Filed: Jul. 22, 1982

[51] Int. Cl.[3] ..... A41B 1/12

[52] U.S. Cl. ..... 2/69; 2/269; 2/221; 2/114

[58] Field of Search ..... 2/69, 78 C, 76, 269, 2/270, 237, 221, 119, 333, 104, 114, 105

[56] References Cited

U.S. PATENT DOCUMENTS

| | | | |
|---|---|---|---|
| 2,747,197 | 5/1956 | Bailey | 2/221 |
| 3,116,491 | 1/1964 | Previdi et al. | 2/114 |
| 3,997,982 | 12/1976 | Holland | 2/119 |

*Primary Examiner*—Doris L. Troutman

*Attorney, Agent, or Firm*—Richard L. Miller

[57] ABSTRACT

A garment made from garment portions detachably attached together and inserts selectively added thereto for enlarging the garment as needed.

3 Claims, 6 Drawing Figures

FABU PATIENT GOWN

This invention relates generally to garments such as nightgowns, robes, jackets, coats, daytime dresses and the like. More specifically it relates to divided garments, such as are made of several components that are selectively assembled together.

BACKGROUND OF THE INVENTION

It is well known that garments of all kinds are generally made as a single assembly that is sewn together in order to fit a specific size of person and who can easily put it on or take it off. However, there are many persons such as hospital patients, invalids and others who find it difficult to put on or take off a conventionally made garment, so that this situation is objectionable and definitely in need of improvement.

SUMMARY OF THE INVENTION

Accordingly, it is a principal object of the present invention to provide a garment that is divided by being made of several components that may be readily disassembled an reassembled together for being more easily put on or taken off, particularly if the person cannot physically move very well such as an invalid or a hospitalized patient in a bed.

Another object is to provide a divided garment which accordingly may selectively include or exclude components as needed, so that the garment will fit a person even if his size becomes changed, or if he otherwise needs some change in the garment assembly.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures on the drawings are briefly described as follows.

DETAILED DESCRIPTION OF PREFERRED EMBODIMENT

Figure 1:
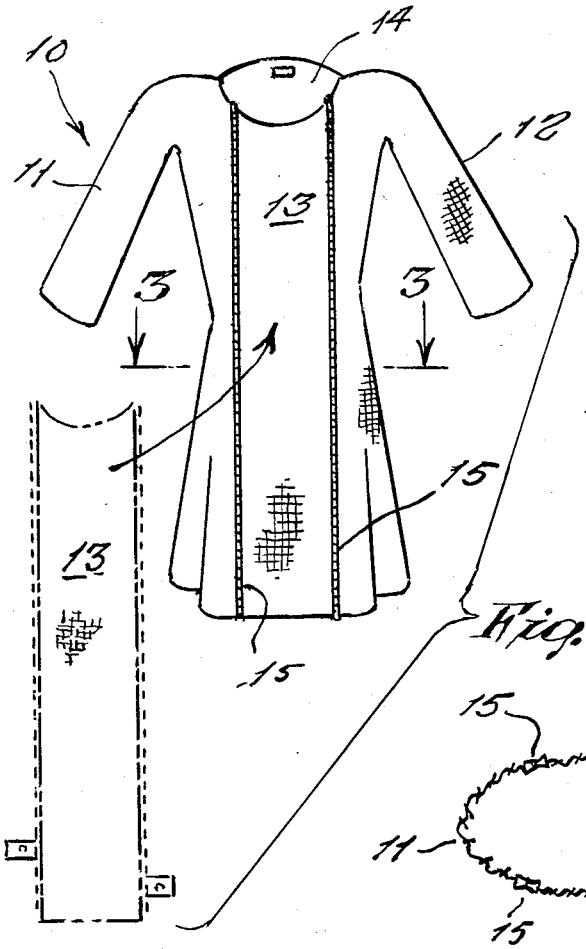
FIG. 1 is a front elevational view of one design of the invention, showing a garment with detachable front and rear insert panel.
Figure 2:
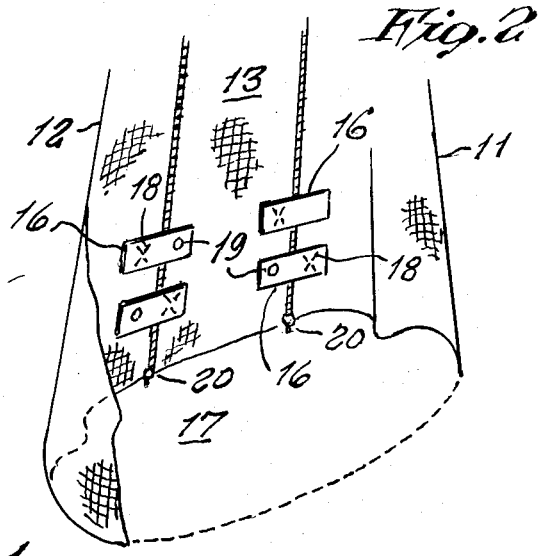
FIG. 2 is a fragmentary perspective view showing a rear side of the front portion of the garment illustrated in FIG. 1.
Figure 3:
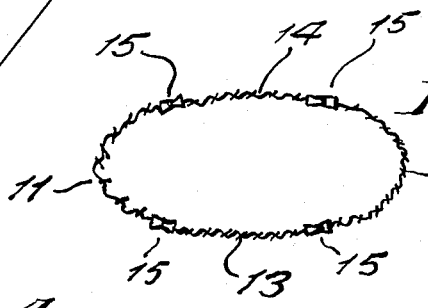
FIG. 3 is a cross sectional view on line 3—3 of FIG. 1.

Referring now to the drawing in greater detail and more particularly to FIGS. 1, 2 and 3 thereof, at this time the reference numeral 10 represents a garment according to the present invention, wherein the same comprises right and left side components 11 and 12 between which a front panel 13 and rear panel 14 are selectively inserted (or removed) as needed and wherein the front and rear panels may be interchanged with other front and rear panels of different widths. All the components are fastened together by means of slide fastener assemblies 15 along mating edges thereof.

Tabs 16 on an inner side 17 of the garment are each permanently secured by stitching 18 at one end to one of the garment components, the tab bridging the assembled slide fastener and the tab other end being detachably secured by a snap button 19 to an adjacent other component of the garment. Thus as shown in FIG. 2, the tabs (located near a starting end of the slide fastener) will serve to prevent them to accidentally slide open, by blocking the slide 20 from moving past the tab.

Alternately the slide fasteners may be substituted by buttons, snap fasteners, loop pile fastener, hooks and eyes or any suitable mechanism for securing garment components together.

The insert panels may be made of various different materials or patterns of materials in order to change a garment style.

Figure 4:
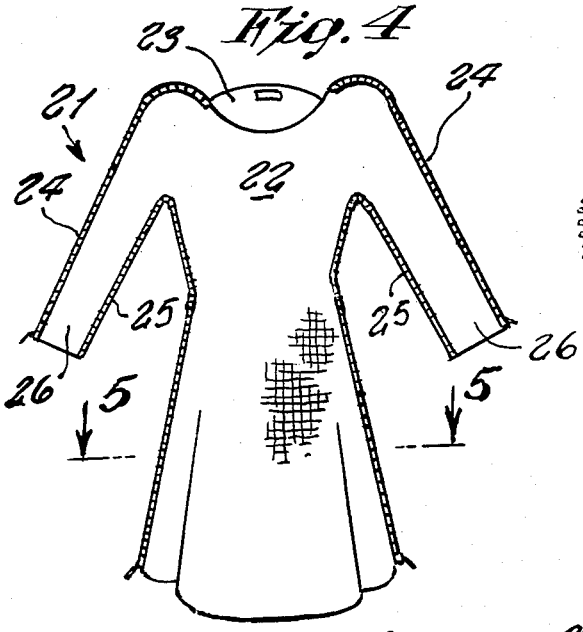
FIG. 4 is a front elevational view of another design of the invention.
Figure 5:
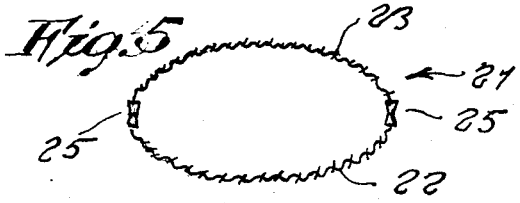
FIG. 5 is a cross sectional view on line 5—5 of FIG. 4.

Referring now to FIGS. 4 and 5, another design of the invention shows a garment 21 having front and rear panels 22 and 23 joined together by upper and lower slide fastener assemblies 24 and 25 above and below the arm openings 26. It is understood that additional right and left side panels (not shown) may be inserted at the slide fasteners in order to make a larger size of the garment.

Figure 6:
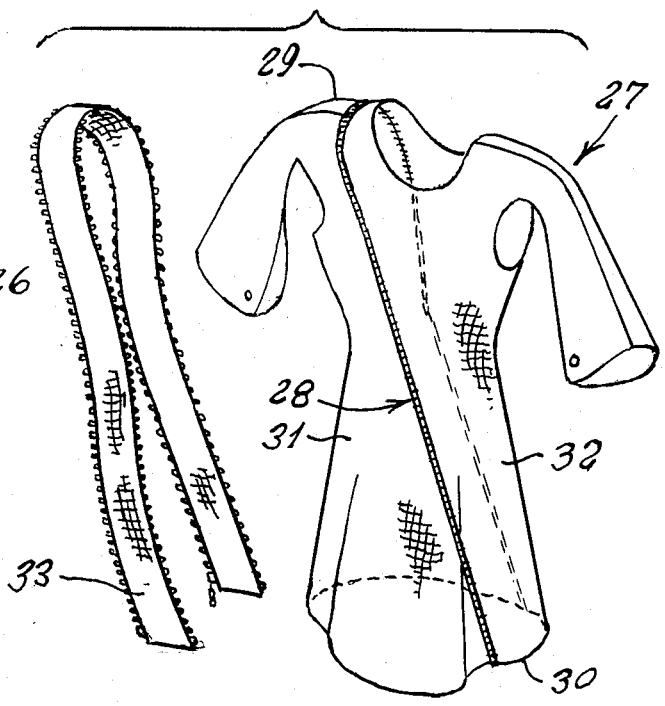
FIG. 6 is a front perspective view of still another design of the invention, showing a detachable panel that extends across the front and rear of the garment.

In FIG. 6, still another design shows a garment 27 with a single slide fastener assembly 28 running angularly across one shoulder 29 and then down to an opposite side of the lower hem 30 so as to join front and rear panels 31 and 32. An insert panel 33 may or may not be added at the slide fastener assembly, as needed.

It is to be further noted that in all embodiments the basic garment can be assembled together without any panel should it be desired to reduce the size of the garment to its minimum size.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

The instant invention has been described completely, divided garments, etc. wearing garments, of various specifications with extended insert panels, full length, or any length is within the spirit of this invention.

I claim:

1. A divided garment, comprising in combination a plurality of panels detachably attached together by fastener means along mating edges of said panels and an insert panel selectively inserted at said fastener means for enlarging said garment, wherein one of said plurality of panels comprises a single diagonal panel, which divides said garment diagonal from one shoulder to the hem line on the opposite side of said shoulder as needed.

2. The combination as set forth in claim 1, wherein said fastener means comprises a single slide fastener assembly.

3. The combination as set forth in claim 1, wherein said fastener means comprises loop pile fastener.

* * * * *